United States Patent [19]

Durth

[11] 3,978,843

[45] Sept. 7, 1976

[54] FOOD COOKING OVEN WITH CONTROLLED AIR CIRCULATION

[75] Inventor: Wilfried Durth, Burbach-Walbach, Germany

[73] Assignee: Buderus'sche Eisenwerke Aktiengesellschaft, 633 Wetzlar, Germany

[22] Filed: Jan. 6, 1975

[21] Appl. No.: 538,562

[30] Foreign Application Priority Data

Jan. 9, 1974 Germany ..... 2400845

[52] U.S. Cl. ..... 126/21 A; 219/400

[51] Int. Cl.[2] ..... A21B 1/26; F24C 15/32

[58] Field of Search ..... 126/21 A; 219/400

[56] References Cited

UNITED STATES PATENTS

| | | | |
|---|---|---|---|
| 3,315,654 | 4/1967 | Keating | 126/21 A |
| 3,727,601 | 4/1973 | Klement | 126/21 A |
| 3,780,721 | 12/1973 | Durth | 126/21 A |

FOREIGN PATENTS OR APPLICATIONS

| | | | |
|---|---|---|---|
| 2,094,630 | 1/1972 | France | 126/21 A |

*Primary Examiner*—Edward G. Favors
*Attorney, Agent, or Firm*—Karl F. Ross; Herbert Dubno

[57] ABSTRACT

A food cooking oven has a closed muffle in which there is provided an axial-input radial-output blower that is rotated by a drive motor outside the housing so as to circulate gases in the housng in a closed path passing through the blower. At least one vane is provided in the housng at one of the sides of the blower so as to limit air circulation therein and prevent excessively strong currents of air in the housing from damaging delicate foodstuffs. This may be a disc vane in front of the axial input of the blower or a pair of elongaged vanes flanking the blower at the output sides thereof.

6 Claims, 6 Drawing Figures

FIG. 1
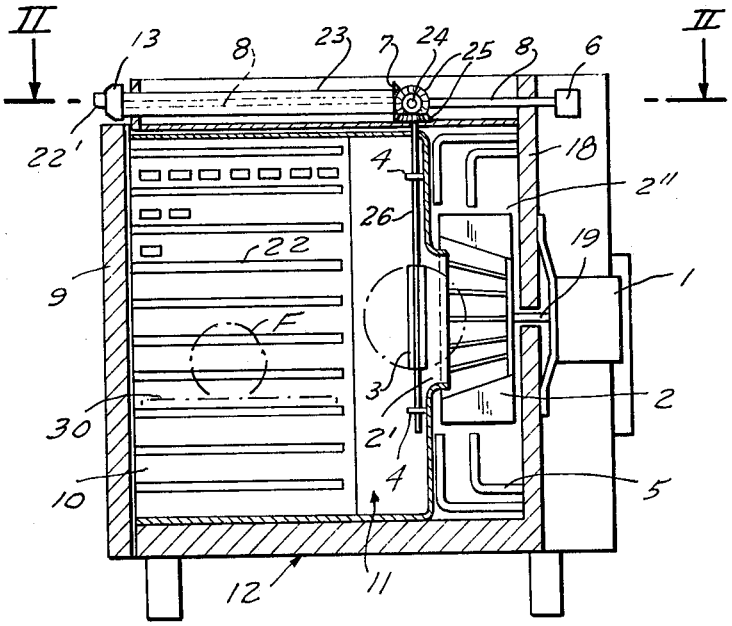
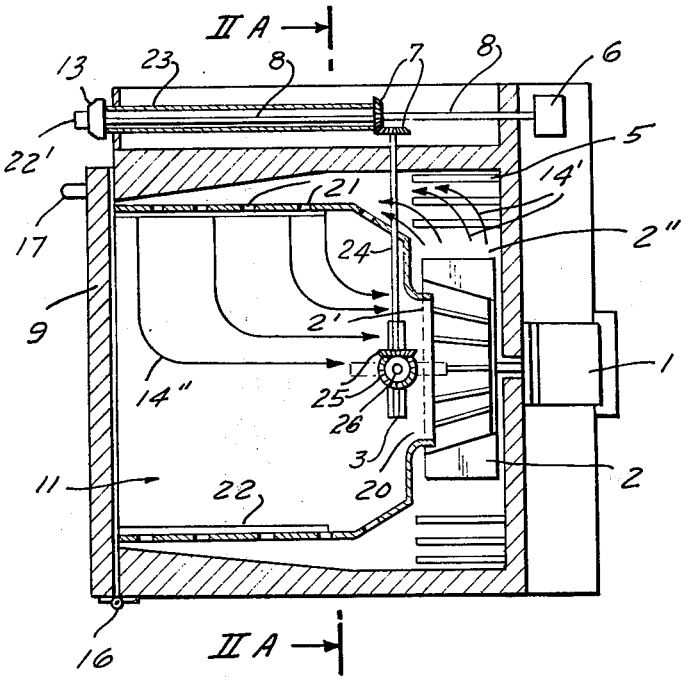
FIG. 2

FIG. 2A
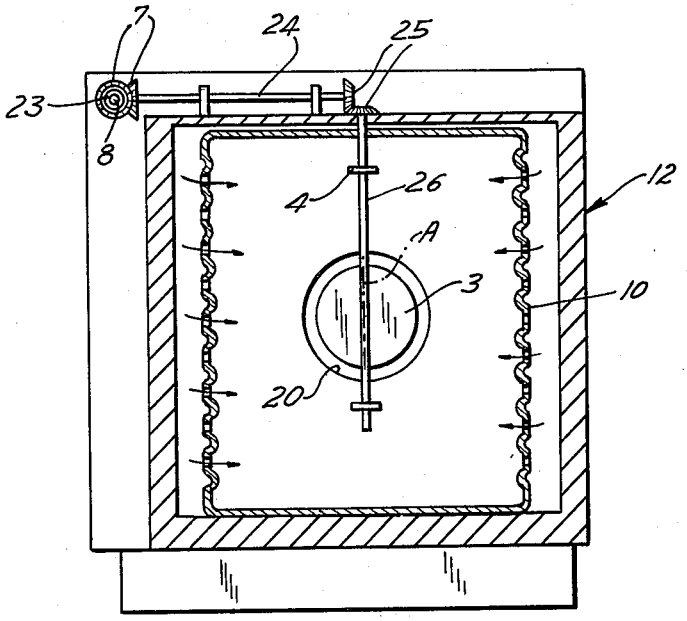
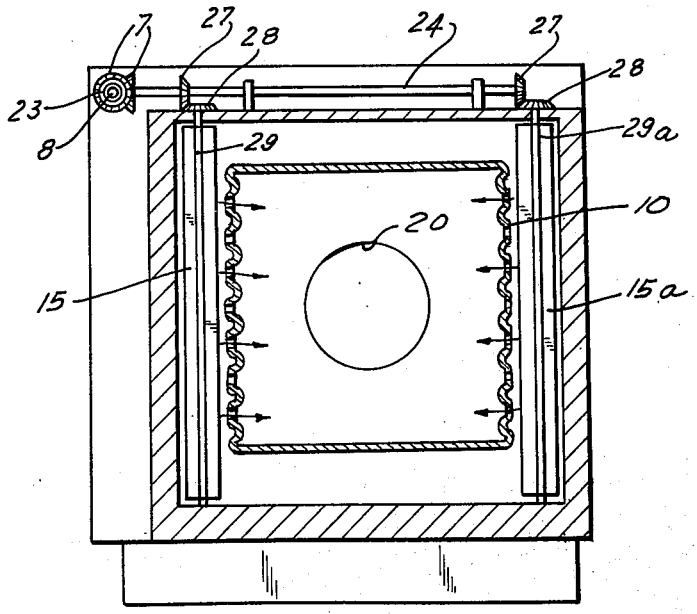
FIG. 4A

FOOD COOKING OVEN WITH CONTROLLED AIR CIRCULATION

CROSS-REFERENCE TO RELATED APPLICATIONS

This application is related to my copending patent applications Ser. No. 343,537 filed Mar. 21, 1973 and Ser. No. 376,447 filed July 5, 1973, now abandoned.

FIELD OF THE INVENTION

This invention relates to the treatment of a foodstuff in a chamber with the circulation of hot gas. More particularly this invention concerns an air-circulating oven wherein the gases in the oven are continuously passed over the foodstuff being treated.

BACKGROUND OF THE INVENTION

Food-treatment devices are known having a muffle in which is provided a heater and blower. The blower circulates gases in the oven in a closed path over the heater, which may be of the electrical resistance type or a gas burner, so as evenly to distribute the heated gases throughout the muffle. Such an arrangement is conventionally used in large commercial installations where convection alone cannot be relied on for adequate heat distribution throughout the muffle.

Such an arrangement, although extremely effective in the large-scale production of roasted goods, baked goods, and the like, does have the disadvantage that certain kinds of foodstuffs are damaged by the constantly circulating gases. Thus flaky pastry, streusel or the like can be damaged by the circulated gases. Nonetheless in such systems it is absolutely necessary to circulate the gases as the heaters are placed in a position where they would be ineffective to heat the muffle without the forced-air circulation. Other types of foodstuffs are also disadvantageously dried out by excessive gas circulation.

OBJECTS OF THE INVENTION

It is therefore an object of the present invention to provide an improved food-treatment system.

Yet another object is the provision of an improved method of and apparatus for treating a foodstuff wherein the gases in the food-treatment muffle are continuously circulated.

A further object is the provision of such a system wherein the possibility of damage to the foodstuff by the flowing stream of gas is eliminated.

SUMMARY OF THE INVENTION

These objects are attained according to the present invention in a system wherein a generally closed housing or muffle is provided with a conventional heater and fan. This fan is driven so as to form a closed air-circulation path passing from the output side of the fan and to the input side thereof. At least one displaceable vane is provided in the housing adjacent one of the sides of the fan and means is provided for adjustably varying the orientation of this vane in the path for controlledly limiting air circulation along the path, thereby controlling the volume rate of air flow through the fan.

Thus in accordance with the present invention it is possible to alter the position of this vane and thereby limit the amount of air circulated throughout the oven.

When streusel, for instance, is being baked, the air flow is limited so as to prevent the particles of the streusel from being carried off the baked goods.

According to yet another feature of this invention the fan is an axial-input radial-output or squirrel-cage blower. A motor mounted outside the housing has its shaft extending through the housing wall and carrying this fan.

In accordance with yet another feature of this invention the vane is a disc provided immediately upstream of the axial input of the blower and controlled via a linkage by a knob on the front of the housing.

According to yet another feature of this invention a pair of such vanes is provided flanking the blower at the radial output side thereof. In this manner the flow is limited while the difficulties incumbent in mounting the vane inside the oven lining are eliminated.

In accordance with yet another feature of this invention each of the vanes is a flat metallic element displaceable between a position parallel to the direction of flow of air in the path and a direction transverse thereto. When oriented transverse to the direction the vane greatly limits air flow. Thus it is possible to provide such a system in a conventional oven without having to alter the motor thereof. This is also important in that squirrel-cage type fans have a greatly decreased efficiency when operated at lower speed so that it is impossible to simply drive them slower to decrease airflow.

BRIEF DESCRIPTION OF THE DRAWING

The above and other objects, features, and advantages of the invention will become more readily apparent from the following description, reference being made to the accompanying drawing in which:

FIG. 1 is a vertical section through an oven in accordance with the present invention;

FIG. 2 is a horizontal section taken along line II — II of FIG. 1;

FIG. 2A is a vertical section taken along line IIA — IIA of FIG. 2;

FIG. 4A is a vertical section taken along line IVA — IVA of FIG. 4.

SPECIFIC DESCRIPTION

Figure 3:
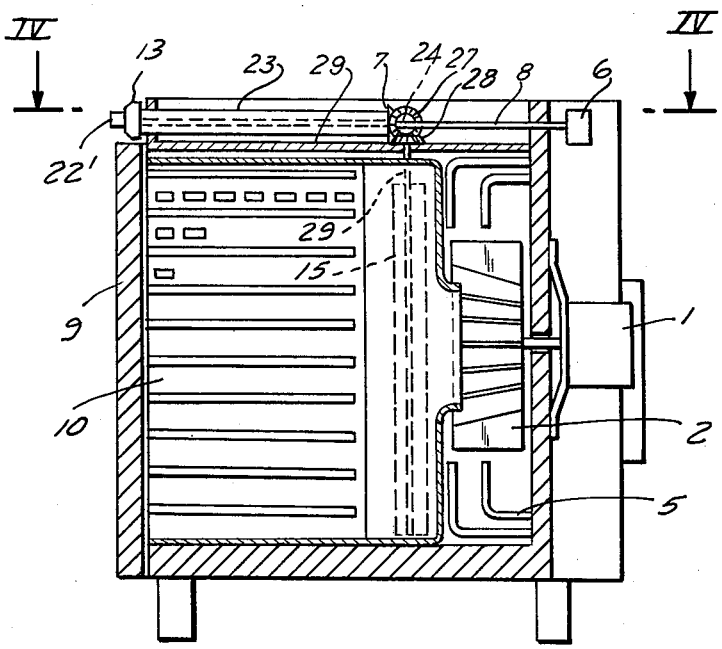
FIG. 3 is a vertical section through another oven in accordance with this invention.

The apparatus according to the present invention as shown in FIGS. 1, 2 and 2A comprises a housing 12 which is generally closed and forms the food-treatment chamber 11 that is closed at its front end by a door 9 hinged at 16 and provided with a handle 17 and at its backside by a back wall 18 on which is mounted a drive motor 1. The shaft 19 of this motor 1 extends through the wall 18 into the chamber 11 and carries an axial-input radial-output fan or blower 2 whose input side 2' is aligned with a back hole 20 in a rack 10 formed on its side walls with holes 21 and with ridges 22 adapted to support at least one shelf 30 on which a foodstuff F is held. As the blower 2 is rotated at high speed it ejects air radially from its output reels 5'' as indicated by arrows 14' such that this air passes around the sides of the rack 10 and enters the rack through the holes 21 whence it is drawn over the foodstuff F and into the blower at its input side 2'. Arranged surrounding the output side 2'' of the blower 2 are a plurality of electric heaters 5 controlled by a thermostat 6 in turn operated by a rod 8 on which is mounted a knob 22 on the front panel of the machine.

Surrounding this rod 8 is a coaxial tube 23 and a corresponding knob 13 surrounding the knob 22 is provided on the front panel of the oven so as to allow rotation of this sleeve 23 on and independent of the rod 8. A bevel gear 7 meshing with another bevel gear 7 as a right-angle drive connects this sleeve 23 to a rod 24 connected in turn via a pair of bevel gears 25 to a further rod 26 which is journaled on the rack 10 at 4 and carries a flat disc 3 arranged directly in front of the hole 20 aligned with the axial input 2' of the blower 2. Thus rotation of the knob 13 serves to rotate its disc 3 about an axis A which is transverse to the direction of flow of gases as they enter the input 2'.

In use the operator first adjusts the knob 22 to determine the heat setting of the heaters 5. Then according to the type of foodstuff being cooked the knob 13 is rotated so as to angularly set the disc 3 and thereby determine the amount of air which will flow in the path indicated by the arrows 14' and 14''. When the disc 3 is aligned (dashed lines in FIG. 2) with the direction of flow it constitutes practically no obstruction and therefore permits full flow into the input 2'. When, however, the disc 3 is oriented parallel to the gas-flow direction (solid lines in FIG. 2), the flow is blocked considerably and only slight gas circulation with the muffle is possible.

Figure 4:
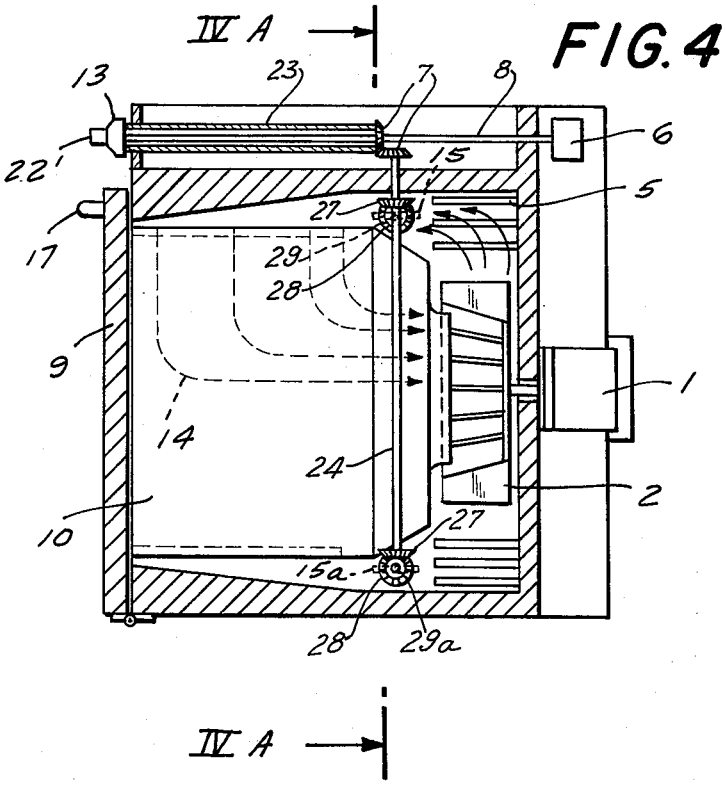
FIG. 4 is a horizontal section taken along line IV — IV of FIG. 3.

The apparatus shown in FIGS. 3, 4 and 4A is identical to that shown in FIGS. 1, 2, and 2A except that here the shaft 24 is provided with two bevel gears 27 and 28 each meshing with their respective bevel gear 27 and 28 carried on respective vertical shaft 29 and 29*a* carrying respective rectangular and planar vanes 15 which are arranged immediately upstream of the outlet side 2'' of the blower 2. In this arrangement no vane is provided at the input side 2' of the blower 2 so that it is possible to withdraw the rack 10 without difficulty.

It should be noted that, regardless of the placement of the circulation limiting vanes 3, 15 and 15*a*, a minimal flow cross-section is left unobstructed so as to prevent the motor from burning out and to avoid excessive heat buildup at the heaters 5.

I claim:

1. An apparatus for treating a foodstuff, said apparatus comprising:

a generally closed housing;

means in said housing for supporting said foodstuff therein;

a fan in said housing having an input side and an output side;

drive means for rotating said fan and circulating air in said housing in a closed path over said foodstuff and through said fan from the input side to the output side thereof;

means in said path in said housing for heating said air;

at least one swingably displaceable vane in said housing adjacent one of said sides; and control means operable externally of said housing and a transmission operatively connecting said control means with said vane varying the orientation of said vane in said path for controlledly limiting air ciculation along said path.

2. The apparatus defined in claim 1 wherein said fan is an axial-input radial-output fan.

3. The apparatus defined in claim 2 wherein said vane is arranged upstream of said input side.

4. The apparatus defined in claim 2 wherein said vane is provided downstream of said output side.

5. The apparatus defined in claim 4 wherein a pair of said vanes are provided flanking said fan at said output side.

6. The apparatus defined in claim 2 wherein said means for supporting includes a rack having perforated side walls and a back wall formed with a hole turned toward said input side.

* * * * *